US006544666B2

(12) United States Patent
Ueda et al.

(10) Patent No.: US 6,544,666 B2
(45) Date of Patent: Apr. 8, 2003

(54) CHEMICALLY PROCESSED STEEL SHEET IMPROVED IN CORROSION RESISTANCE

(75) Inventors: Kouichiro Ueda, Sakai (JP); Shigeyasu Morikawa, Sakai (JP); Tadashi Nakano, Sakai (JP); Yasumi Ariyoshi, Sakai (JP); Keiji Izumi, Sakai (JP); Masanori Matsuno, Sakai (JP); Hirofumi Taketsu, Sakai (JP)

(73) Assignee: Nisshin Steel Co., Ltd. (JP)

( * ) Notice: Subject to any disclaimer, the term of this patent is extended or adjusted under 35 U.S.C. 154(b) by 0 days.

(21) Appl. No.: 10/035,554

(22) Filed: Nov. 9, 2001

(65) Prior Publication Data

US 2002/0090529 A1 Jul. 11, 2002

(30) Foreign Application Priority Data

Nov. 10, 2000 (JP) ..... 2000-342938
Jun. 18, 2001 (JP) ..... 2001-183044

(51) Int. Cl.[7] ..... B32B 15/18; B32B 33/00

(52) U.S. Cl. ..... 428/659; 428/629; 428/632; 428/633; 428/469; 428/472; 428/472.1; 428/472.3; 428/696; 428/697; 428/702; 428/908.8

(58) Field of Search ..... 428/659, 629, 428/632, 633, 469, 472, 472.1, 472.3, 696, 697, 702, 908.8; 148/246, 247, 253, 261, 273, 274

(56) References Cited

U.S. PATENT DOCUMENTS 4,233,088 A * 11/1980 Kronstein ..... 428/472.3

FOREIGN PATENT DOCUMENTS

| | | | |
|---|---|---|---|
| JP | 51-2419 | 1/1976 | ..... C23F/7/00 |
| JP | 1-130762 | 5/1989 | ..... B05D/3/10 |
| JP | 6-146003 | 5/1994 | ..... C23C/22/40 |
| JP | 7-115002 | 12/1995 | ..... B05D/3/10 |
| JP | 11-061431 | 3/1999 | ..... C23C/22/40 |

* cited by examiner

*Primary Examiner*—Robert R. Koehler
(74) *Attorney, Agent, or Firm*—Webb Ziesenheim Logsdon Orkin & Hanson, P.C.

(57) ABSTRACT

A new processed steel sheet comprising of a steel base coated with a Zn or its alloy plating layer and a converted layer, which contains both of at least an insoluble or scarcely-soluble metal compound and at least a soluble metal compound. The insoluble or scarcely-soluble compound may be one or more of valve metal oxides or hydroxides, and the soluble compound may be one or more of valve metal fluorides. The converted layer may be also composed of one or more of complex compounds of Mn and Ti. The insoluble or scarcely-soluble compound acts as a barrier for insulation of a steel base from an atmosphere, while the soluble compound exhibits a self-repairing faculty to repair defective parts of the converted layer. Due to the converted layer, the processed steel sheet is remarkably improved in corrosion resistance, without the presence of chromium compounds which would put harmful influences on the environment.

11 Claims, No Drawings

CHEMICALLY PROCESSED STEEL SHEET IMPROVED IN CORROSION RESISTANCE

BACKGROUND OF THE INVENTION

1. Field of the Invention

The present invention relates to a chemically processed steel sheet remarkably improved in corrosion resistance by generation of a converted layer with a self-repairing faculty on a surface of a zinc plating layer.

2. Description of Related Art

Zn or its alloy-coated steel sheets (hereinafter referred to as "zinc-coated steel sheet") have been used as corrosion-resistant material. But, when the zinc-coated steel sheet is held as such in a humid atmosphere, exhaust gas or an environment subjected to dispersion of sea salt grains for a long time, its external appearance is worsened due to generation of white rust on the plating layer. Generation of white rust is conventionally inhibited by chromating.

A conventional chromate layer is composed of complex oxides and hydroxides of trivalent and hexavalent Cr. Scarcely-soluble compounds of Cr(III) such as $Cr_2O_3$ act as a barrier against a corrosive atmosphere and protects a steel base from corroding reaction. Compounds of Cr(VI) are dissolved as oxoatic anions such as $Cr_2O_7^{2-}$ from the converted layer and re-precipitated as scarcely-soluble compounds of Cr(III) due to reducing reaction with exposed parts of a steel base formed by working or machining. Re-precipitation of Cr(III) compounds automatically repairs defective parts of the converted layer, so that corrosion-preventing faculty of the converted layer is still maintained after working or machining.

Although chromating effectively inhibits generation of white rust, it obliges a big load on post-treatment of Cr ion-containing waste fluid. In this consequence, various methods using chemical liquors, which contains titanium compound, zirconate, molybdate or phosphate instead of chromate, have been proposed for generation of Cr-free converted layers.

As for generation of a molybdate layer, JP 51-2419 B1 proposed a method of dipping a steel member in a chemical liquor containing magnesium or calcium molybdate, and JP 6-146003 A1 proposed a method of applying a chemical liquor, which contains a partially reduced oxide of Mo(VI) at a ratio of Mo(VI)/total Mo to 0.2–0.8, to a steel member. As for generation of a titanium-containing layer, JP 11-61431 A1 proposed a method of applying a chemical liquor, which contains titanium sulfate and phosphoric acid, to a galvanized steel sheet.

These converted layers, which have been proposed instead of the conventional chromate layer, do not exhibit such a self-repairing faculty as the chromate layer.

For instance, a titanium-containing layer does not exhibits a self-repairing faculty due to insolubility, although it is uniformly generated on a surface of a steel base in the same way as the chromate layer. As a result, the titanium-containing layer is ineffective for suppression of corrosion starting at defective parts formed during chemical conversion or plastic deformation. The other Cr-free converted layers are also insufficient for corrosion prevention due to poor self-repairing faculty.

A chemical liquor, which is prepared by mixing phosphoric acid to an aqueous titanium sulfate solution, is easy to generate precipitates. Once precipitates are generated, it is difficult to uniformly spread the chemical liquor to a surface of a steel base, resulting in generation of an ununiform converted layer. When precipitates are included in the converted layer, adhesiveness of the converted layer and external appearance of the processed steel sheet are worsened. Corrosion resistance of the converted layer would be degraded due to residual sulfate radical. Moreover, composition of the chemical liquor is often varied to a state unsuitable for generation of a converted layer with high quality due to the precipitation.

A manganese-containing converted layer, which is generated from a phosphate liquor, is relatively soluble, and dissolution of the converted layer occurs in a humid atmosphere. In this regard, an effect of the converted layer on corrosion resistance is inferior, even if the converted layer is thickened. Furthermore, the phosphate liquor shall be intensively acidified due to poor solubility of manganese phosphate. The acidified liquor violently reacts with a zinc plating layer, and loses its validity in a short while.

SUMMARY OF THE INVENTION

The present invention aims at provision of a processed zinc-coated steel sheet remarkably improved in corrosion resistance by generation of a converted layer, which contains insoluble or scarcely-soluble compounds useful as a barrier for insulation of a steel base from an atmosphere and soluble compounds with a self-repairing faculty for repairing damaged parts of the converted layer.

The present invention proposed a new processed zinc-coated steel sheet comprising a steel base coated with a Zn or its alloy plating layer and a chemically converted layer, which contains at least one complex compound of Ti and Mn, generated on a surface of the plating layer. The complex compound is selected from oxides, phosphates, fluorides and organic acid salts of Mn and Ti. The organic acid salts preferably have carboxylic groups.

A chemical liquor for generation of such a converted layer contains one or more of manganese compounds, titanium compounds, phosphoric acid or phosphates, fluorides and organic acids. The organic acid preferably has a carboxylic group. The chemical liquor is adjusted at pH 1–6.

The present invention proposes another new processed steel sheet comprising the same steel base and a converted layer, which contains both of at least one oxide or hydroxide and at least one fluoride of valve metals, generated on a surface of a Zn or its alloy plating layer. The valve metal is an element, whose oxide exhibits high insulation resistance, such as Ti, Zr, Hf, V, Nb, Ta, Mo or W. A self-repairing faculty of the converted layer is apparently noted by incorporation of a fluoride in the converted layer at an F/O atomic ratio not less than 1/100.

The converted layer may further contains one or more of soluble or scarcely-soluble metal phosphates or complex phosphates. The soluble metal phosphate or complex phosphate may be a salt of alkali metal, alkaline earth metal or Mn. The scarcely-soluble metal phosphate or complex phosphate may be a salt of Al, Ti, Zr, Hf or Zn.

After the chemical liquor is spread to a zinc-coated steel sheet, the steel sheet is dried as such at 50–200° C. without washing to generate a converted layer on a surface of a plating layer.

DETAILED DESCRIPTION OF THE PREFERRED EMBODIMENTS

Manganese compounds and valve metal fluorides are effective components other than chromium compound, which give a self-repairing faculty to a converted layer, since these compounds are once dissolved to water in an atmosphere and then re-precipitated as scarcely-soluble compounds at defective parts of the converted layer.

A manganese compound present in a converted layer is partially changed to a soluble component effective for realization of a self-repairing faculty. Accounting the feature of the manganese-containing converted layer, the inventors experimentally added various kinds of chemicals and researched effects of the chemicals on corrosion resistance. In the course of researches, the inventors discovered that addition of titanium compound to a chemical liquor for generation of a manganese compound converted layer effectively suppresses dissolution of the converted layer without weakening a self-repairing faculty.

Improvement of corrosion resistance by addition of titanium compound is supposed by the following reasons, and confirmed by the under-mentioned examples.

A converted layer, which is generated from a manganese phosphate liquor on a surface of a zinc plating layer, is relatively porous. The porous layer allows permeation of corrosive components therethrough to a steel base, resulting in occurrence of corrosion.

On the other hand, when a converted layer is generated from a titanium-containing chemical liquor, pores of the converted layer are filled with titanium compounds precipitated from the chemical liquor. The titanium compounds are insoluble or scarcely-soluble and act as a barrier for shielding a steel base from an atmosphere. Moreover, since the chemical liquor is controlled in an acid range to dissolve the titanium salt, dissolution of Zn from a Zn or its alloy plating layer is promoted. The dissolved Zn is re-precipitated as zinc hydrate useful as a corrosion inhibitor at pores of the converted layer. Consequently, the converted layer is superior of corrosion resistance and exhibits a self-repairing faculty. Furthermore, the titanium compound can be dissolved without excessively falling a pH value, due to co-presence of titanium ion with manganese ion in the chemical liquor.

A valve metal fluoride present in a converted layer is also a soluble component effective for realization of a self-repairing faculty. The valve metal is an element, whose oxide exhibits high insulation resistance, such as Ti, Zr, Hf, V, Nb, Ta, Mo and W. In a converted layer, which contains one or more oxides or hydroxides of valve metals together with one or more fluorides of valve metals, generated on a surface of a zinc plating layer, the oxide or hydroxide acts as a resistance against transfer of electrons and suppresses reducing reaction caused by oxygen dissolved in water (oxidizing reaction of a steel base, in turn), while the fluoride is once dissolved to water in an atmosphere and then re-precipitated as scarcely-soluble compounds at the defective parts of the converted layer. Consequently, dissolution (corrosion) of metal components from a steel base is inhibited. Especially, tetravalent compounds of Group-IV A metals such as Ti, Zr and Hf are stable components for generation of converted layers excellent in corrosion resistance.

The oxide or hydroxide of the valve metal is effective as a resistance against transfer of electrons, when a converted layer is uniformly generated on a surface of a steel base. However, occurrence of defective parts in a converted layer is practically unavoidable during chemical conversion, press-working or machining. At the defective parts where the steel base is exposed to an atmosphere, the converted layer does not sufficiently inhibit corroding reaction. Such the defective parts are automatically repaired by the self-repairing faculty of the valve metal fluoride, and the corrosion-preventing function of the converted layer is recovered.

For instance, a titanium-containing layer generated on a surface of a steel base is composed of $TiO_2$ and $Ti(OH)_2$. When the titanium-containing layer is microscopically observed, defects such as pinholes and very thin parts are detected in the titanium-containing layer. The defects act as starting points for corroding reaction, since the steel base is exposed to an atmosphere through the defects. Although a conventional chromate layer exhibits a self-repairing faculty due to re-precipitation of a scarcely-soluble Cr(III) compound at defective parts, such the self-repairing faculty is not expected as for the titanium-containing layer. Defective parts of the converted layer are reduced by thickening the converted layer, but the hard titanium-containing layer poor of ductility does not follow to elongation of a steel base during working the chemically processed steel sheet. As a result, defects such as cracks and scratches easily occur in the converted layer during working or machining.

On the other hand, co-presence of a fluoride such as $X_nTiF_6$ (X is an alkali metal, an alkaline earth metal or $NH_4$, and n is 1 or 2) or $TiF_4$ in the converted layer promotes dissolution of a fluoride to water in an atmosphere and re-precipitation of a scarcely-soluble oxide or hydroxide according to the formula of $TiF_6^{2-}+4H_2O \rightarrow Ti(OH)_4+6F^-$. The re-precipitation means realization of a self-repairing faculty. A metal part of the fluoride may be either the same as or different from a metal part of the oxide or hydroxide. Some oxoates of Mo or W useful as a valve metal exhibit such the self-repairing faculty due to solubility, so as to relax restrictions on a kind of a fluoride to be incorporated in a converted layer.

A steel base, which is to be chemically processed according to the present invention, is a steel sheet coated with a Zn or its alloy plating layer by electroplating, hot-dip coating or vacuum deposition coating. The Zn alloy plating layer may be Zn—Al, Zn—Mg, Zn—Ni or Zn—Al—Mg. An alloyed zinc-coated steel sheet, which has been subjected to alloying treatment after hot-dip coating, is also used as a steel base for chemical processing.

A chemical liquor for generation of a converted layer containing a complex compound of Mn and Ti is an acid solution containing one or more of manganese compounds and titanium compounds. The manganese compound may be one or more of $Mn(H_2PO_4)_2$, $MnCO_3$, $Mn(NO_3)_2$, $Mn(OH)_2$, $MnSO_4$, $MnCl_2$ and $Mn(C_2H_3O_2)_2$. The titanium compound may be one or more of $K_2TiF_6$, $TiOSO_4$, $(NH_4)_2TiF_6$, $K_2[TiO(COO)_2]$, $TiCl_4$ and $Ti(OH)_4$.

The manganese compound is preferably added to a chemical liquor at a ratio not less than 0.1 g/l calculated as Mn, to gain a deposition rate of Mn sufficient for corrosion resistance. But, excessive addition of Mn more than 100 g/l unfavorably worsens stability of the chemical liquor. The titanium compound is preferably added at a Ti/Mn mole ratio not less than 0.05 for improvement of corrosion resistance without degrading a self-repairing faculty of the converted layer. An effect of titanium compound on corrosion resistance is intensified as increase of a Ti/Mn mole ratio, but an excessive Ti/Mn mole ratio more than 2 causes instability of the chemical liquor and also rising of a process cost.

The chemical liquor contains phosphoric acid or phosphate, which etches a surface of a Zn or its alloy plating layer to an activated state and changes to a scarcely-soluble phosphate effective for corrosion resistance. The phosphate may be manganese phosphate, sodium dihydrogenphosphate, disodium hydrogenphosphate, magnesium phosphate and ammonium dihydrogenphosphate. Phosphoric acid or phosphate is preferably added to the chemical liquor at a P/Mn mole ratio of 0.2–4. An effect of phosphoric acid or phosphate on corrosion resistance is apparently noted at a P/Mn mole ratio not less than 0.2, but an excessive P/Mn mole ratio above 4 means too-intensified etching action and instability of the chemical liquor.

The chemical liquor further contains one or more of fluorides, which also etch a surface of a Zn or its alloy plating layer to an activated state, and chelate manganese compounds and titanium compounds. The fluoride may be hydrogen fluoride, titanium fluoride, ammonium fluoride, potassium fluoride or silicofluoric acid.

An organic acid with chelating function is further added to the chemical liquor, to maintain scarcely-soluble metals such as Mn and Ti as stable metal ions. The organic acid may be one or more of tartaric, tannic, citric, oxalic, malonic, lactic and acetic acids. The organic acid is preferably added at an organic acid/Mn mole ratio of 0.05–1. An effect of the organic acid on chelation of metal ions for stabilization of the chemical liquor is typically noted at an organic acid/Mn mole ratio not less than 0.05, but an excessive ratio more than 1 falls a pH value of the chemical liquor and worsens continuous processability.

The manganese compound, the titanium compound, the phosphoric acid or phosphate, the fluoride and the organic acid are mixed together at ratios to adjust a pH value of the chemical liquor to 1–6. As falling of a pH value, etching action of the chemical liquor on a surface of the Zn or its alloy plating layer is accelerated, and the surface of the plating layer is reformed to an activated state in a short time. However, excessive falling of a pH value below 1 causes violent dissolution of Zn from the plating layer and instability of the chemical liquor, and an excessively higher pH value above 6 also degrades stability of the chemical liquor due to precipitation of titanium compounds.

A chemical liquor for generation of a converted layer containing compounds of a valve metal is either a coat-type or reaction-type. The reaction-type chemical liquor is preferably adjusted to a relatively low pH value to assure its stability. The following explanation uses Ti as a valve metal, but the other valve metals are also useful in the same way.

A chemical liquor contains a soluble halide or oxoate as a Ti source. Titanium fluoride is useful as both Ti and F sources, but a soluble fluoride such as $(NH_4)F$ may be supplementarily added to the chemical liquor. In concrete, the Ti source may be $X_nTiF_6$ (X is an alkali or alkaline earth metal, n is 1 or 2), $K_2[TiO(COO)_2]$, $(NH_4)_2TiF_6$, $TiCl_4$, $TiOSO_4$, $Ti(SO_4)_2$ or $Ti(OH)_4$. Ratios of these fluorides are determined such that a converted layer having predetermined composition of oxide(s) or hydroxide(s) and fluoride(s) is generated by drying and baking a steel sheet after application of the chemical liquor.

An organic acid with chelating faculty may be further added to the chemical liquor, in order to maintain a Ti source as a stable ion in the chemical liquor. Such the organic acid may be one or more of tartaric, tannic, citric, oxalic, malonic, lactic and acetic acids. Especially, oxycarboxylic acids such as tartaric acid and polyhydric phenols such as tannic are advantageous in stability of the chemical liquor, assist a self-repairing faculty of a fluoride and adhesiveness of a paint film. The organic acid is preferably added to the Orthophosphates or polyphosphates of various metals may be added for incorporation of soluble or scarcely-soluble metal phosphates or complex phosphates in a converted layer.

A soluble metal phosphate or complex phosphate is dissolved from a converted layer, reacted with Zn and Al in a steel base through defective parts of the converted layer and re-precipitated as scarcely-soluble phosphates which assist a self-repairing faculty of a titanium fluoride. An atmosphere is slightly acidified on dissociation of the soluble phosphate, so as to accelerate hydrolysis of the titanium fluoride, in other words generation of scarcely-soluble titanium oxide or hydroxide. A metal component capable of generating a soluble phosphate or complex phosphate is an alkali metal, an alkaline earth metal, Mn and so on. These metals are added as metal phosphates alone or together with phosphoric acid, polyphosphoric acid or another phosphate to the chemical liquor.

A scarcely-soluble metal phosphate or complex phosphate is dispersed in a converted layer, resulting in elimination of defects and increase of strength. A metal component capable of generating a scarcely-soluble phosphate or complex phosphate is Al, Ti, Zr, Hf, Zn and so on. These metals are added as metal phosphates alone or together with phosphoric acid, polyphosphoric acid or another phosphate to the chemical liquor.

Among various kinds of zinc-coated steel sheets, a steel sheet coated with an Al-containing plating layer has the disadvantage that its surface is easily blackened. Such blackening is inhibited by incorporation of one or more salts of Fe, Co and Ni in the converted layer. A self-repairing faculty derived from fluoride and phosphate is sometimes insufficient, when big cracks are generated in the converted layer by plastic deformation of the steel sheet with a heavy work ratio. In this case, the self-repairing faculty is intensified by adding one or more of soluble oxoates of Mo(VI) and W(VI) to the converted layer at a great ratio. Such the oxoates exhibit the same function as Cr(VI) to repair the defective parts of the converted layer, resulting in recovery of corrosion resistance.

One or more lubricants are optionally added to the chemical liquor, to bestow a converted layer with lubricity. The lubricant may be powdery synthetic resins, for instance polyolefin resins such as fluorocarbon polymer, polyethylene and polypropylene, styrene resins such as ABS and polystyrene, or halide resins such as vinyl chloride and vinylidene chloride. An inorganic substance such as silica, molybdenum disulfide, graphite and talc may be also used as the lubricant. Improvement of workability of a processed steel sheet is noted by addition of the lubricant to the converted layer at a ratio not less than 1 mass %, but excessive addition above 25 mass % impedes generation of the converted layer, resulting in degradation of corrosion resistance.

After the chemical liquor prepared as above-mentioned is spread to a Zn or its alloy plating layer formed on a steel sheet by an applicator roll, a spinner, a sprayer or the like, the steel sheet is dried as such without washing to generate a converted layer good of corrosion resistance on a surface of the plating layer. The chemical liquor is preferably applied at a ratio not less than 10 $mg/m^2$ calculated as deposited Mn or at a ratio not less than 1 $mg/m^2$ calculated as deposited valve metal for realization of sufficient corrosion resistance.

Concentrations of elements incorporated in the converted layer are measured by X-ray fluorescence, ESCA or the like. A quantitative effect of the chemical liquor on corrosion resistance is saturated at 1000 $mg/m^2$ calculated as deposited Mn, and further improvement of corrosion resistance is not expected any more even by thickening the converted layer.

As for a converted layer containing valve metal compounds, a corrosion resistance of the converted layer can be evaluated in relation with an F/O atomic ratio, which is calculated from the measured F and O concentrations, on corrosion resistance. Corroding reaction, which starts at defective parts of the converted layer, is remarkably suppressed at an F/O atomic ratio not less than 1/100. Suppression of corrosion proves realization of a self-repairing faculty derived from titanium fluoride incorporated in the converted layer at a quantitatively sufficient ratio.

The steel sheet, which has a converted layer generated from the chemical liquor applied to a surface of a plating layer, may be dried at an ordinary temperature, but is preferably dried in a short time at a temperature of 50° C. or higher accounting continuous processability. However, drying at a too-higher temperature above 200° C. causes thermal decomposition of organisms of a converted layer, resulting in degradation of corrosion-resistance.

An organic paint film good of corrosion resistance may be laid on the converted layer. Such the paint film is formed by applying a resin paint containing one or more of olefinic resins such as urethane, epoxy, polyethylene, polypropylene and ethylene-acrylic copolymer, styrenic resins such as polystyrene, polyesters, acrylic resins or these copolymers or degenerated resins. The resin paint may be applied to the converted layer by an applicator roll or electrostatic atomization. When a paint film of 0.5–5 $\mu$m in thickness is laid on the converted layer, the converted layer surpasses a conventional chromate layer in corrosion resistance. The converted layer can be bestowed with lubricity or weldability by laminating an organic paint film good of electric conductivity thereon.

EXAMPLE

Two kinds of steel sheets were used as a steel base for chemical processing. A steel sheet A was of 0.5 mm in thickness and electroplated with Zn at a deposition ratio of 20 g/m$^2$ per single surface. A steel sheet B was of 0.5 mm in thickness and hot-dip coated with a Zn-6 mass % Al-3 mass % Mg alloy at a deposition ratio of 50 g/m$^2$ per single surface. These steel sheets A and B were preparatively degreased and pickled.

Converted Layer Containing Complex Compound of Mn and Ti

Manganese compounds, titanium compounds, fluorides, phosphoric acid or phosphates and organic acids were mixed together at various ratios to prepare several chemical liquors having compositions shown in Table 1. Each liquor just after preparation and left as such for 25 hours at 50° C. after preparation was observed. Stability of each liquor was evaluated according to presence (×) or absence (○) of precipitates.

analyzed by X-ray fluorescence and ESCA to measure concentration of Mn in the converted layer and to calculate ratios of Ti/Mn, P/Mn, organic acid/Mn and F/Mn. Results are shown in Table 2.

Test pieces were cut off each processed steel sheet and subjected to a corrosion test. In the corrosion test, each test piece was sealed at its edge, and a NaCl solution of 35° C. was sprayed under the conditions regulated in JIS Z2371. After the salt water spraying was continued for a predetermined time, a surface of the test piece was observed to detect occurrence of white rust. A surface area rate of the test piece occupied by white rust was calculated. Corrosion-resistance of the chemically processed steel sheet was evaluated according to calculation results of the area rates as follows: an area rate not more than 5% as ⊙, an area rate of 5–10% as ○, an area rate of 10–30% as Δ, an area rate of 30–50% as ▲ and an area rate more than 50% as ×.

Results are shown in Table 2, wherein a processed steel sheet, which had a chromate layer generated by a conventional chromating liquor (offered as ZM-3387 by Nihon Parkerizing Co., Ltd.) was testified as a comparative example under the same conditions.

It is understood from the results shown in Table 2 that any of the converted layers generated according to the present invention was superior to a conventional chromate layer in corrosion resistance. The converted layer was well affinitive with a paint film formed thereon.

The steel sheet A was used as a steel base in the above-mentioned examples, but a Zn alloy-electroplated steel sheet

TABLE 1

COMPOSITIONS OF CHEMICAL LIQUORS USED IN EXAMPLE

| Liquor | manganese compound | | titanium compound | | phosphoric acid or phosphate | | an organic acid | | fluoride | | | | |
|---|---|---|---|---|---|---|---|---|---|---|---|---|---|
| No. | kind | (1) | kind | (2) | kind | (3) | kind | (4) | kind | (5) | pH | Stability | NOTE |
| 1 | $Mn(H_2PO_4)_2$ | 15 | $(NH_4)_2TiF_6$ | 1 | (Mn salt) | 2 | tartaric | 0.3 | (titanium) compound) | 6 | 3.0 | ○ | Inventive Examples |
| 2 | $Mn(H_2PO_4)_2$ | 60 | $(NH_4)_2TiF_6$ | 0.1 | $H_3PO_4$ | 3 | tartaric + tannic | 0.8 | (titanium compound) | 0.6 | 2.2 | ○ | |
| 3 | $Mn(H_2PO_4)_2$ | 1 | $K_2TiF_6$ | 1.5 | (Mn salt) | 2 | oxalic | 1 | $(NH_4)F$ | 10 | 5.1 | ○ | |
| 4 | $Mn(H_2PO_4)_2$ | 15 | $K_2[TiO(COO)_2]$ | 0.2 | $H_3PO_4$ | 4 | (titanium compound) | 0.4 | $(NH_4)F$ | 8 | 2.0 | ○ | |
| 5 | $MnCO_3$ | 10 | $(NH_4)_2TiF_6$ | 0.8 | $H_3PO_4$ | 0.2 | citric | 1 | (titanium compound) | 4.8 | 4.3 | ○ | |
| 6 | $Mn(NO_3)_2$ | 100 | $TiOSO_4$ | 0.5 | $H_3PO_4$ | 1 | tannic + malonic | 0.5 | KF | 3 | 1.2 | ○ | |
| 7 | $Mn(H_2PO_4)_2$ | 20 | — | — | (Mn salt) | 2 | citric | 0.01 | $(NH_4)F$ | 2 | 4.0 | X | Comparative Examples |
| 8 | $Mn(NO_3)_2$ | 100 | — | — | — | — | tartaric | 0.8 | (titanium compound) | 3 | 2.7 | ○ | |
| 9 | $Mn(H_2PO_4)_2$ | 30 | — | — | (Mn salt) | 2 | tartaric | 0.5 | KF | 0.06 | 3.0 | ○ | |
| 10 | $MnCO_3$ | 20 | — | — | $H_3PO_4$ | 1 | — | 0.6 | $(NH_4)F$ | 0.02 | 1.5 | X | |

(1) Mn concentration (g/l)
(2) a Ti/Mn mole ratio
(3) a P/Mn mole ratio
(4) an organic acid/Mn mole ratio
(5) a F/Mn mole ratio Chemical Liquors Nos. 1–6, 8 and 9, in which precipitates were not detected after preparation, were used for chemically processing a steel sheet A. After each chemical liquor was spread to the steel sheet, the steel sheet was carried in an electric oven and dried as such at 150° C. A converted layer generated on a surface of the Zn plating layer was or other Zn or its alloy-coated steel sheet manufactured by a hot-dip or vacuum deposition process is also useful as a steel base. In fact, the inventors have confirmed that remarkable improvement of corrosion resistance is attained by generation of a converted layer containing complex compounds of Ti and Mn on these steel sheets.

TABLE 2

COMPOSITIONS OF CONVERTED LAYERS AND CORROSION RESISTANCE

| NOTE | Liquor No. | deposition rate ($mg/m^2$) of Mn | A mole ratio of each component Ti/Mn | P/Mn | F/Mn | an organic acid/Mn | a baking temp. (° C.) | presence or absence of white rust by a salt water spraying test 24 hrs. after | 72 hrs. after | 120 hrs. after |
|---|---|---|---|---|---|---|---|---|---|---|
| Inventive examples | 1 | 50 | 1 | 2 | 6 | 0.2 | 150 | ◎ | ◎ | ◎ |
| | 2 | 100 | 0.1 | 3 | 0.6 | 0.8 | 80 | ◎ | ◎ | ◎ |
| | 3 | 10 | 2 | 2 | 10 | 0.7 | 200 | ◎ | ○ | ○ |
| | 4 | 80 | 0.2 | 4 | 8 | 0.4 | 120 | ◎ | ◎ | ◎ |
| | 5 | 60 | 0.8 | 0.2 | 4.8 | 1 | 100 | ◎ | ◎ | ◎ |
| | 6 | 200 | 0.5 | 1 | 3 | 0.5 | 100 | ◎ | ◎ | ◎ |
| Comparative Examples | 1 | 5 | 0 | 2 | 6 | 0.2 | 150 | Δ | X | X |
| | 8 | 100 | 0 | — | 3 | 0.8 | 100 | ○ | X | X |
| | 9 | 60 | 0 | 2 | 0.06 | 0.5 | 120 | ▲ | X | X |
| Conventional Chromating | | a chromate layer (Cr: 10 $mg/m^2$) | | | | | 100 | ◎ | Δ | X |
| | | a chromate layer (Cr: 50 $mg/m^2$) | | | | | 120 | ◎ | ◎ | ◎ |

Addition of a Lubricant to Converted Layer Containing Complex Compound of Mn and Ti Several lubricants shown in Table 3 were separately added to the chemical liquor No. 1 in Table 1, to prepare lubricant-containing chemical liquors. Each chemical liquor was applied to a steel sheet A under the same conditions as above-mentioned. A converted layer was nearly the same as the converted layer, which did not contain any lubricant, in Mn concentration as well as mole ratios of Ti/Mn, P/Mn, an organic acid/Mn and F/Mn.

Test pieces were cut off each processed steel sheet and subjected to a corrosion test to evaluate corrosion resistance at a worked part. In the corrosion test, each test piece of 35 mm ×200 mm in size was tested by bead drawing examination under conditions of bead height of 4 mm, radius of 4 mm at a top of a bead and a pressure of 4.9 kN, and then the same salt water was sprayed to the worked test piece for a predetermined time. Thereafter, the worked part of the test piece was observed, and corrosion-resistance at the worked part was evaluated under the same standards.

Results are shown in Table 3. It is understood that workability of each processed steel sheet was improved by incorporation of a lubricant in a converted layer, and that corrosion resistance even at a worked part was still maintained at a level surpassing a conventional chromate layer. On the other hand, converted layers, which did not contain lubricants, were poor of corrosion resistance due to introduction of many defects caused by insufficient lubricity.

TABLE 3

EFFECTS OF LUBRICANTS ON CORROSION RESISTANCE AT WORKED PARTS

| Liquor No. | Lubricant Kind | a ratio (mass %) in a chemical liquor | a ratio (mass %) of a lubricant in a converted layer | presence or absence of white rust by a salt water spraying test 24 hrs. after | 48 hrs. after |
|---|---|---|---|---|---|
| 11 | polyethylene | 1 | 5 | ◎ | ◎ |
| 12 | Talc | 2 | 10 | ◎ | ○ |
| 13 | Fluororesin | 0.5 | 3 | ◎ | ◎ |
| 1 | without a lubricant | | — | ▲ | X |

Converted Layer Containing Titanium Compounds

Several chemical liquors having compositions shown in Table 4 were prepared by mixing various Ti and F sources optionally together with metal compounds, organic acids and phosphates.

TABLE 4

CHEMICAL LIQUORS USED IN EXAMPLE 1

| Liquor No. | a Ti source kind | (1) | a F source Kind | (2) | a phosphate source kind | (3) | an organic acid Kind | (4) | other metal salts kind | (5) | NOTE |
|---|---|---|---|---|---|---|---|---|---|---|---|
| 1 | $(NH_4)_2TiF_6$ | 20 | (titanium compound) | 47.5 | $H_3PO_4$ | 40 | tannic acid | 4 | — | — | Inventive Examples |

TABLE 4-continued

CHEMICAL LIQUORS USED IN EXAMPLE 1

| Liquor | a Ti source | | a F source | | a phosphate source | | an organic acid | | other metal salts | | |
|---|---|---|---|---|---|---|---|---|---|---|---|
| No. | kind | (1) | Kind | (2) | kind | (3) | Kind | (4) | kind | (5) | NOTE |
| 2 | $(NH_4)_2TiF_6$ | 12 | (titanium compound) | 28.5 | $Mn(H_2PO_4)_2$ | 16.9 | tartaric acid | 15 | Mn (phosphate) | Mn: 15 | |
| 3 | $K_2TiF_6$ | 10 | (titanium compound) | 23.8 | $(NH_4)H_2PO_4$ | 5 | citric acid | 2 | $(NH_4)_6Mo_7O_{23}$ | Mo: 3 | |
| 4 | $K_2[TiO(COO)_2]$ | 15 | $(NH_4)F$ | 15 | $MgHPO_4$ | 24 | (titanium compound) | 27.6 | Mg (phosphate) | Mg: 19 | |
| 5 | $(NH_4)_2TiF_6$ | 30 | (titanium compound) | 71.3 | $H_3PO_4$ | 50 | tannic acid | 5 | $CO(NO_3)_2$ | Co: 1 | |
| 6 | $TiOSO_4$ | 50 | $(NH_4)F$ | 5 | $(NH_4)H_2PO_4$ | 20 | tartaric acid | 10 | $Al(NO_3)_2$ | Al: 3 | |
| 7 | $(NH_4)_2TiF_6$ | 10 | (titanium compound) | 23.8 | — | — | tartaric acid | 10 | — | | |
| 8 | $TiOSO_4$ | 20 | — | — | $H_3PO_4$ | 5 | — | — | $Mg(NO_3)_2$ | Mg: 3 | Comparative |
| 9 | — | — | $(NH_4)F$ | 10 | $H_3PO_4$ | 20 | tannic acid | 2 | $Mg(NO_3)_2$ | Mg: 5 | Examples |

(1) concentration (g/l) of Ti
(2) concentration (g/l) of F
(3) concentration (g/l) of P
(4) concentration (g/l) of an organic acid
(5) concentration (g/l) of a metal After the chemical liquors Nos. 1–9 are individually spread to each of the steel sheets A and B, the steel sheet was carried in an electric oven and dried as such at 50–200° C. without washing. For comparison, a Zn-coated steel sheet was dried at a temperature up to 150° C. under the same conditions without washing, after application of a conventional chromating liquor (offered as ZM-3387 by Nihon Parkerizing Co., Ltd.).

A converted layer, which was generated on each zinc plating layer, contained various elements at ratios shown in Table 5.

TABLE 5

COMPOSITIONS OF CONVERTED LAYERS

| Liquor No. | a steel base | a ratio ($mg/m^2$) of deposited Ti | concentration (atomic %) of each element in a converted layer: Ti | O | F | P | other metals | NOTE |
|---|---|---|---|---|---|---|---|---|
| 1 | A | 42 | 4 | 70 | 14 | 12 | — | Inventive |
| | B | 38 | 4 | 71 | 13 | 12 | — | Examples |
| 2 | A | 31 | 4 | 68 | 14 | 9 | Mn: 5 | |
| | B | 34 | 4 | 69 | 13 | 9 | Mn: 5 | |
| 3 | A | 15 | 7 | 54 | 33 | 5 | Mo: 1 | |
| | B | 16 | 7 | 53 | 34 | 5 | Mo: 1 | |
| 4 | A | 44 | 3 | 78 | 3 | 8 | Mg: 8 | |
| | B | 42 | 3 | 78 | 3 | 8 | Mg: 8 | |
| 5 | A | 54 | 5 | 63 | 19 | 12 | Co: 1 | |
| | B | 58 | 5 | 66 | 15 | 13 | Co: 1 | |
| 6 | A | 72 | 9 | 84 | 1 | 5 | Al: 1 | |
| | B | 70 | 9 | 83 | 2 | 5 | Al: 1 | |
| 7 | A | 30 | 10 | 47 | 43 | — | — | |
| | B | 27 | 10 | 49 | 41 | — | — | |
| 8 | A | 51 | 18 | 70 | — | 7 | Mg: 5 | Comparative |
| | | 49 | 19 | 69 | — | 7 | Mg: 5 | Examples |
| 9 | A | (P:30) | — | 69 | 11 | 15 | Mg: 5 | |
| | B | (P:32) | — | 67 | 13 | 15 | Mg: 5 | |
| 10 | a chromate layer (Cr: 10 $mg/m^2$) | | | | | | | |
| 11 | a chromate layer (Cr: 50 $mg/m^2$) | | | | | | | |

Steel base A: a zinc-electroplated steel sheet

Steel base B: a steel sheet hot dip-coated with a Zn-6% Al-3% Mg alloy

Elements such as Zn, Zn—Al—Mg are excluded from "other metals" (except for use of a chemical liquor containing such elements)

Elements included in a converted layer from a steel base are 1–3 mass % Zn as for the steel base A, and 1–3 mass % Zn, 0.1–0.5 mass % Al and 0.1–0.5 mass % Mg as for the steel base B Test pieces were cut off each processed steel sheet and subjected to a corrosion test for evaluation of corrosion resistance at both a flat plane and at a worked part.

In the corrosion test for evaluation of corrosion-resistance at a flat plane, an edge of each test piece was sealed, and a 5%-NaCl solution was sprayed onto a flat plane of the test piece under the conditions regulated in JIS Z2371. After the salt water spraying was continued for 24, 72 and 120 hours, the flat plane of the test piece was observed to detect occurrence of white rust. A surface area rate of the test piece occupied by white rust was calculated. Corrosion-resistance of the steel sheet was evaluated in response to calculation results of the area rates as follows: an area rate not more than 5% as ⊙, an area rate of 5–10% as ○, an area rate of 10–30% as Δ, an area rate of 30–50% as ▲ and an area rate more than 50% as ×.

In the corrosion test for evaluation of corrosion resistance at a worked part, each test piece was bent with an angle of 180° in the manner such that a steel base was partially exposed to an atmosphere through cracks generated in a converted layer at an area rate of 1:5 to a surface of a plating layer covered with a crack-free converted layer. After the same salt water was sprayed 24 and 48 hours to the bent test piece, the bent part was observed to measure an area of white rust. Corrosion resistance at the bent part was evaluated in response to a surface area rate of the bent part occupied by the white rust as follows: an area rate less than 5% as ⊙, an area rate of 5–10% as ○, an area rate of 10–30% as Δ. an area rate of 30–50% as ▲ and an area rate more than 50% as ×.

Results are shown in Table 6. It is understood that converted layers generated according to the present invention surpassed a conventional chromate layer in corrosion resistance at both a flat plane and a worked part. Zinc plating layers covered with such the converted layers were good of affinity with paint films. A converted layer of Sample No. 7, which did not contain phosphates, was also good of corrosion resistance in a relatively shorter testing time.

On the other hand, a converted layer of Sample No. 8, which did not contain soluble titanium fluoride, was poor of corrosion resistance, as corrosion originated in defective parts of the converted layer was detected at the bent part. A converted layer of Sample No. 9, which did not contain titanium fluoride, was poor of corrosion resistance at bot the flat plane and the worked part.

TABLE 6

CORROSION RESISTANCE OF PROCESSED STEEL SHEETS

| Sample | Liquor | a baking | generation of white rust at a flat plane by a salt water spraying test after; | | | generation of white rust at a worked part by a salt water spraying test after; | | |
|---|---|---|---|---|---|---|---|---|
| No. | No. | temp. (° C.) | 24 hrs. | 72 hrs. | 120 hrs. | 24 hrs. | 48 hrs. | NOTE |
| 1A | 1 | 150 | ⊙ | ⊙ | ⊙ | ⊙ | ⊙ | Inventive |
| 1B | | | ⊙ | ⊙ | ⊙ | ⊙ | ⊙ | Examples |
| 2A | 2 | 80 | ⊙ | ⊙ | ○ | ⊙ | ⊙ | |
| 2B | | | ⊙ | ⊙ | ⊙ | ⊙ | ⊙ | |
| 3A | 3 | 200 | ⊙ | ⊙ | ○ | ⊙ | ⊙ | |
| 3B | | | ⊙ | ⊙ | ○ | ⊙ | ⊙ | |
| 4A | 4 | 120 | ⊙ | ⊙ | ⊙ | ⊙ | ○ | |
| 4B | | | ⊙ | ⊙ | ⊙ | ⊙ | ○ | |
| 5A | 5 | 100 | ⊙ | ⊙ | ⊙ | ⊙ | ⊙ | |
| 5B | | | ⊙ | ⊙ | ⊙ | ⊙ | ⊙ | |
| 6A | 6 | 100 | ⊙ | ⊙ | ⊙ | ⊙ | ⊙ | |
| 6B | | | ⊙ | ⊙ | ⊙ | ⊙ | ⊙ | |
| 7A | 7 | 120 | ○ | X | X | ○ | ▲ | |
| 7B | | | ○ | ▲ | X | ○ | ▲ | |
| 8A | 8 | 150 | ⊙ | ○ | Δ | ▲ | X | Comparative |
| 8B | | | ⊙ | ⊙ | ○ | X | X | Examples |
| 9A | 9 | 100 | X | X | X | X | X | |
| 9B | | | ▲ | X | X | X | X | |
| 10A | 10 | 150 | ⊙ | Δ | X | ○ | X | |
| 10B | | | ⊙ | X | X | Δ | X | |
| 11A | 11 | 150 | ⊙ | ⊙ | ⊙ | ▲ | X | |
| 11B | | | ⊙ | ⊙ | ⊙ | ⊙ | Δ | |

Converted Layer Containing Compounds of Valve Metal other than Ti

The steel sheets A and B were chemically processed using several chemical liquors shown in Table 7. A converted layer generated on each steel sheet A and B contained various elements. Concentrations of these elements are shown in Table 8.

TABLE 7

COMPOSITIONS OF CHEMICAL LIQUORS

| Sample | a valve metal source | | an F source | | a phospahte | | an organic acid | | other metal salts | |
|---|---|---|---|---|---|---|---|---|---|---|
| No. | Kind | (1) | kind | (2) | kind | (3) | kind | (4) | kind | (5) |
| 1 | $(NH_4)_2ZrF_6$ | 10 | (zirconium salt) | 12.5 | $H_3PO_4$ | 6 | tartaric | 10 | — | |

TABLE 7-continued

COMPOSITIONS OF CHEMICAL LIQUORS

| Sample | a valve metal source | | an F source | | a phospahte | | an organic acid | | other metal salts | |
|---|---|---|---|---|---|---|---|---|---|---|
| No. | Kind | (1) | kind | (2) | kind | (3) | kind | (4) | kind | (5) |
| 2 | $Zr(SO_4)_2$ | 8 | $NH_4F$ | 15 | $Mn(H_2PO_4)_2$ | 7.9 | tartaric | 5 | Mn(phosphate) | Mn: 7 |
| 3 | $Na_2WO_4$ | 20 | (titanium | 2.4 | $H_3PO_4$ | 30 | oxalic | 8 | — | — |
| | $(NH_4)_2TiF_6$ | 1 | salt) | | | | | | | |
| 4 | $TiSO_4$ | 20 | (vanadium | 15 | $MgHPO_4$ | 12 | tannic | 5 | Mg(phosphate) | Mg: 9.3 |
| | $VF_4$ | 10 | salt) | | | | | | | |
| 5 | $K_2NbF_7$ | 16 | (niobium salt) | 22.6 | $H_3PO_4$ | 20 | oxalic | 15 | — | — |
| 6 | $K_2(MoO_2F_4)$ | 20 | (molybdenum salt) | 15.8 | $(NH_4)H_2PO_4$ | 15 | tartaric | 10 | — | — |
| 7 | $H_2TiF_6$ | 2 | (titanium | 4.8 | $(NH_4)H_2PO_4$ | 10 | tartaric | 20 | — | — |
| | $V_2O_5$ | 20 | salt) | | | | | | | |
| 8 | $(NH_4)VO_3$ | 5 | (molybdenum | 3.7 | $(NH_4)H_2PO_4$ | 5 | citric | 5 | — | — |
| | $Na_2(MoO_2F_4)$ | 5 | salt) | | | | | | | |

(1) concentration (g/l) of a valve metal
(2) concentration (g/l) of F
(3) concentration (g/l) of P
(4) concentration (g/l) of an organic acid
(5) concentration (g/l) of another metal

TABLE 8

COMPOSITIONS OF CONVERTED LAYERS

| Liquor No. | a steel base | a ratio ($mg/m^2$) of a deposited valve metal | a valve metal | concentration (atomic %) of elements in a converted layer: O | F | P | other metals |
|---|---|---|---|---|---|---|---|
| 1 | A | Zr: 52 | Zr: 5 | 65 | 22 | 8 | — |
| | B | Zr: 49 | Zr: 5 | 64 | 23 | 8 | — |
| 2 | A | Zr: 41 | Zr: 2 | 74 | 13 | 7 | Mn: 4 |
| | B | Zr: 43 | Zr: 2 | 76 | 11 | 7 | Mn: 4 |
| 3 | A | W: 40 | W: 2 | 80 | 1.5 | 16 | — |
| | | Ti: 7 | Ti: 0.5 | | | | |
| | B | W: 40 | W: 2 | 79 | 1.5 | 15 | — |
| | | Ti: 7 | Ti: 0.5 | | | | |
| 4 | A | Ti: 44 | Ti: 6 | 70 | 9 | 6 | Mg: 6 |
| | | V: 21 | V: 3 | | | | |
| | B | Ti: 42 | Ti: 6 | 69 | 10 | 6 | Mg: 6 |
| | | V: 20 | V: 3 | | | | |
| 5 | A | Nb: 61 | Nb: 3 | 64 | 21 | 12 | — |
| | B | Nb: 64 | Nb: 3 | 66 | 19 | 12 | — |
| 6 | A | Mo: 51 | Mo: 5 | 71 | 13 | 11 | — |
| | B | Mo: 49 | Mo: 5 | 74 | 10 | 11 | — |
| 7 | A | Ti: 1.9 | Ti: 1 | 76 | 5 | 8 | — |
| | | V: 31 | V: 10 | | | | |
| | B | Ti: 1.8 | Ti: 1 | 77 | 4 | 8 | — |
| | | V: 30 | V: 10 | | | | |

TABLE 8-continued

COMPOSITIONS OF CONVERTED LAYERS

| Liquor No. | a steel base | a ratio ($mg/m^2$) of a deposited valve metal | a valve metal | concentration (atomic %) of elements in a converted layer: O | F | P | other metals |
|---|---|---|---|---|---|---|---|
| 8 | A | Mo: 21 | Mo: 3 | 77 | 7 | 7 | — |
| | | V: 20 | V: 6 | | | | |
| | B | Mo: 20 | Mo: 3 | 78 | 8 | 7 | — |
| | | V: 22 | V: 6 | | | | |

Steel base A: a zinc-electroplated steel sheet
Steel base B: a steel sheet hot dip-coated with a Zn-6% Al-3% Mg alloy
Elements such as Zn, Zn—Al—Mg are excluded from "other metals" (except for use of a chemical liquor containing such elements)
Elements included in a converted layer from a steel base are 1–3 mass % Zn as for the steel base A, and 1–3 mass % Zn, 0.1–0.5 mass % Al and 0.1–0.5 mass % Mg as for the steel base B Test pieces were cut off each processed steel sheet and subjected to the same corrosion tests. Results are shown in Table 9. It is understood that any of the zinc-coated steel sheets processed according to the present invention is good of corrosion resistance at both the flat plane and the worked part.

TABLE 9

CORROSION RESISTANCE OF PROCESSED STEEL SHEETS

| Sample No. | Liquor No. | a baking temp. (° C.) | generation of white rust at a flat plane by a salt water spraying test after; 24 hrs. | 72 hrs. | 120 hrs. | generation of white rust at a worked part by a salt water spraying test after; 24 hrs. | 48 hrs. |
|---|---|---|---|---|---|---|---|
| 1A | 1 | 70 | ◎ | ◎ | ◎ | ◎ | ◎ |
| 1B | | | ◎ | ◎ | ◎ | ◎ | ◎ |
| 2A | 2 | 170 | ◎ | ◎ | ◎ | ◎ | ○ |
| 2B | | | ◎ | ◎ | ◎ | ◎ | ○ |
| 3A | 3 | 120 | ◎ | ◎ | ○ | ◎ | ◎ |
| 3B | | | ◎ | ◎ | ◎ | ◎ | ◎ |

TABLE 9-continued

CORROSION RESISTANCE OF PROCESSED STEEL SHEETS

| Sample | Liquor | a baking | generation of white rust at a flat plane by a salt water spraying test after; | | | generation of white rust at a worked part by a salt water spraying test after; | |
|---|---|---|---|---|---|---|---|
| No. | No. | temp. (° C.) | 24 hrs. | 72 hrs. | 120 hrs. | 24 hrs. | 48 hrs. |
| 4A | 4 | 130 | ◎ | ◎ | ◎ | ◎ | ◎ |
| 4B | | | ◎ | ◎ | ◎ | ◎ | ◎ |
| 5A | 5 | 100 | ◎ | ◎ | ◎ | ◎ | ◎ |
| 5B | | | ◎ | ◎ | ◎ | ◎ | ◎ |
| 6A | 6 | 130 | ◎ | ◎ | ◎ | ◎ | ◎ |
| 6B | | | ◎ | ◎ | ◎ | ◎ | ◎ |
| 7A | 7 | 120 | ◎ | ◎ | ◎ | ◎ | ◎ |
| 7B | | | ◎ | ◎ | ◎ | ◎ | ◎ |
| 8A | 8 | 150 | ◎ | ◎ | ○ | ◎ | ◎ |
| 8B | | | ◎ | ◎ | ○ | ◎ | ◎ |

The chemically processed steel sheet according to the present invention as above-mentioned comprises a steel base coated with a Zn or its alloy plating layer and a a converted layer, which contains a scarcely-soluble metal compound and a soluble metal compound, generated on a surface of the plating layer. The scarcely-soluble metal compound acts as a barrier for insulation of the steel base from an atmosphere, and the soluble metal compound exhibits a self-repairing faculty. Defective parts of the converted layer, which are generated during plastic deformation of the steel sheet, are automatically repaired by re-precipitation of scarcely-soluble fluorides, so that the processed steel sheet still maintains excellent corrosion resistance without partial exposure of a steel base to an atmosphere even after plastic deformation.

The converted layer can be bestowed with sufficient lubricity so as to enable plastic deformation of the processed steel sheet with a heavy work ratio, by addition of a lubricant to the converted layer. Improved lubricity effectively reduces occurrence of defects, which would act as starting points for corroding reaction. Corrosion resistance of the processed steel sheet is further improved to a level surpassing a conventional chromate layer, by incorporation of phosphoric acid or phosphate therein. Moreover, the converted layer is-free from Cr which would put harmful influences on the environment.

Accounting these features, the processed steel sheets will be used in broad industrial fields instead of a conventional chromated steel sheet.

What is claimed is:

1. A chemically processed steel sheet excellent in corrosion resistance, comprising:

a steel base coated with a Zn or its alloy plating layer; and a converted layer containing both of at least one insoluble or scarcely-soluble metal compound and at least one soluble metal compound, generated on a surface of said Zn or its alloy plating layer.

2. The chemically processed steel sheet defined in claim 1, wherein the converted layer includes at least one complex compound of Mn and Ti.

3. The chemically processed steel sheet defined in claim 2, wherein the complex compound is selected from oxides, phosphates, fluorides and organic acids.

4. The chemically processed steel sheet defined in claim 2, wherein the converted layer further contains one or more lubricants.

5. The chemically processed steel sheet defined in claim 2, wherein the converted layer further contains one or more of insoluble or soluble phosphates and complex phosphates.

6. The chemically processed steel sheet defined in claim 2, wherein the converted layer further contains one or more of organic acid salts.

7. The chemically processed steel sheet defined in claim 1, wherein the insoluble or scarcely-soluble metal compound is one or more of oxides and hydroxides of valve metals, and the soluble metal compound is one or more of valve metal fluorides.

8. The chemically processed steel sheet defined in claim 7, wherein the valve metal is selected from Ti, Zr, Hf, V, Nb, Ta, Mo and W.

9. The chemically processed steel sheet defined in claim 7, wherein the converted layer contains the fluoride at an F/O atomic ratio not less than approximately 1/100.

10. The chemically processed steel sheet defined in claim 7, wherein the converted layer further contains one or more of soluble or insoluble phosphates and complex phosphates.

11. The chemically processed steel sheet defined in claim 7, wherein the converted layer further contains one or more of organic acid salts.

* * * * *

UNITED STATES PATENT AND TRADEMARK OFFICE

CERTIFICATE OF CORRECTION

PATENT NO. : 6,544,666 B2
DATED : April 8, 2003
INVENTOR(S) : Kouichiro Ueda et al.

It is certified that error appears in the above-identified patent and that said Letters Patent is hereby corrected as shown below:

Column 5,
Line 47, after "added to the" insert -- chemical liquor at an organic acid/Mn mole ratio not less than 0.02. --

Column 17,
Line 43, between "is" and "free" delete hyphen (-).

Signed and Sealed this

Fourteenth Day of October, 2003

JAMES E. ROGAN
*Director of the United States Patent and Trademark Office*